US008955597B2

(12) United States Patent
Connell et al.

(10) Patent No.: US 8,955,597 B2
(45) Date of Patent: Feb. 17, 2015

(54) METHOD AND SYSTEM FOR ABANDONING A BOREHOLE

(75) Inventors: Paul L. Connell, Spring, TX (US); Erik Vilhelm Nordenstam, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 798 days.

(21) Appl. No.: 13/153,795

(22) Filed: Jun. 6, 2011

(65) Prior Publication Data

US 2012/0305249 A1 Dec. 6, 2012

(51) Int. Cl.
*E21B 29/00* (2006.01)
*E21B 33/13* (2006.01)
*E21B 7/28* (2006.01)

(52) U.S. Cl.
CPC ..... *E21B 29/005* (2013.01); *E21B 33/13* (2013.01); *E21B 7/28* (2013.01)
USPC ..... 166/361; 166/290; 166/55.7

(58) Field of Classification Search
CPC ..... E21E 33/13; E21B 29/002; E21B 29/005; E21B 29/007; E21B 29/08; E21B 29/00
USPC ..... 166/361, 285, 290, 297, 298, 55–55.8
See application file for complete search history.

(56) References Cited

U.S. PATENT DOCUMENTS

| | | | | |
|---|---|---|---|---|
| 2,690,897 | A * | 10/1954 | Clark, Jr. | 175/268 |
| 2,976,927 | A * | 3/1961 | Kammerer, Jr. et al. | 166/55.8 |
| 3,289,760 | A * | 12/1966 | Kammerer | 166/290 |
| 5,255,741 | A | 10/1993 | Alexander | |
| 6,478,088 | B1 * | 11/2002 | Hansen et al. | 166/285 |
| 6,920,923 | B1 | 7/2005 | Pietrobelli et al. | |
| 7,380,603 | B2 * | 6/2008 | Jeffrey et al. | 166/285 |
| 8,528,630 | B2 * | 9/2013 | Tunget | 166/55.8 |
| 2010/0032170 | A1 | 2/2010 | Howett et al. | |
| 2011/0017450 | A1 | 1/2011 | Pietrobelli et al. | |
| 2011/0127035 | A1 * | 6/2011 | Hansen et al. | 166/297 |
| 2011/0220357 | A1 * | 9/2011 | Segura et al. | 166/298 |
| 2013/0105158 | A1 * | 5/2013 | Saltel | 166/290 |
| 2013/0199785 | A1 * | 8/2013 | Hekelaar | 166/298 |

OTHER PUBLICATIONS

Charles H. Dewey et al., "Drilling and underreaming Simultaneously: A Cost-Effective Option"; Society of Petroleum Engineers; SPE Paper No. 36462; Oct. 6, 1996.

J.M. Greener et al., "Underreamer Improvements for Drilling Moving Salt Formations"; Society of Petroleum Engineers; SPE/IADC Paper No. 18700; Feb. 28, 1989.

Notification of Transmittal of the International Search Report and the Written Opinion of the International Searching Authority; PCT/US2012/040486; Mailed Dec. 21, 2012; Korean Intellectual Property Office; 7 pages.

* cited by examiner

*Primary Examiner* — Shane Bomar
*Assistant Examiner* — Kipp Wallace
(74) *Attorney, Agent, or Firm* — Cantor Colburn LLP

(57) ABSTRACT

A method of abandoning a borehole includes, running a tool into the borehole, cutting a casing with a first portion of the tool, reaming the borehole in an area where the casing has been cut with a second portion of the tool, disconnecting a drillstring from the tool, and cementing the borehole through the drillstring.

8 Claims, 2 Drawing Sheets

METHOD AND SYSTEM FOR ABANDONING A BOREHOLE

BACKGROUND

Abandoning a borehole in an earth formation such as is employed in the hydrocarbon recover and the carbon dioxide sequestration industries typically includes cementing the borehole to seal it potentially permanently.

In order to assure no leakage occurs between a liner or casing (if the borehole is so equipped) and the earth formation, it is common to cut away a portion of the liner or casing and then to ream or open the borehole in the cut portion to assure that cement interfaces directly with the formation. As such, abandoning a well takes time to individually run and retrieve the specialized tools employed to perform each of the cutting, reaming and cementing operations.

With the high labor and equipment costs tied up during operations such as abandoning a well, for example, methods and systems that minimize the time to finish the abandonment operation will be well received in the art.

BRIEF DESCRIPTION

Disclosed herein is a method of abandoning a borehole. The method includes, running a tool into the borehole, cutting a casing with a first portion of the tool, reaming the borehole in an area where the casing has been cut with a second portion of the tool, disconnecting a drillstring from the tool, and cementing the borehole through the drillstring.

Further disclosed herein is a borehole abandoning system. The system includes a tubular and a tool in operable communication with the tubular. The tool has a first portion configured to at least cut walls lining a borehole over a selected extent and a second portion configured to ream at least a portion of the selected open hole extent of the borehole. The system also has a connector configured to disconnect the tubular from the tool after the walls are cut with the first portion, and the open hole extent is reamed by the second portion all during a single run into the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
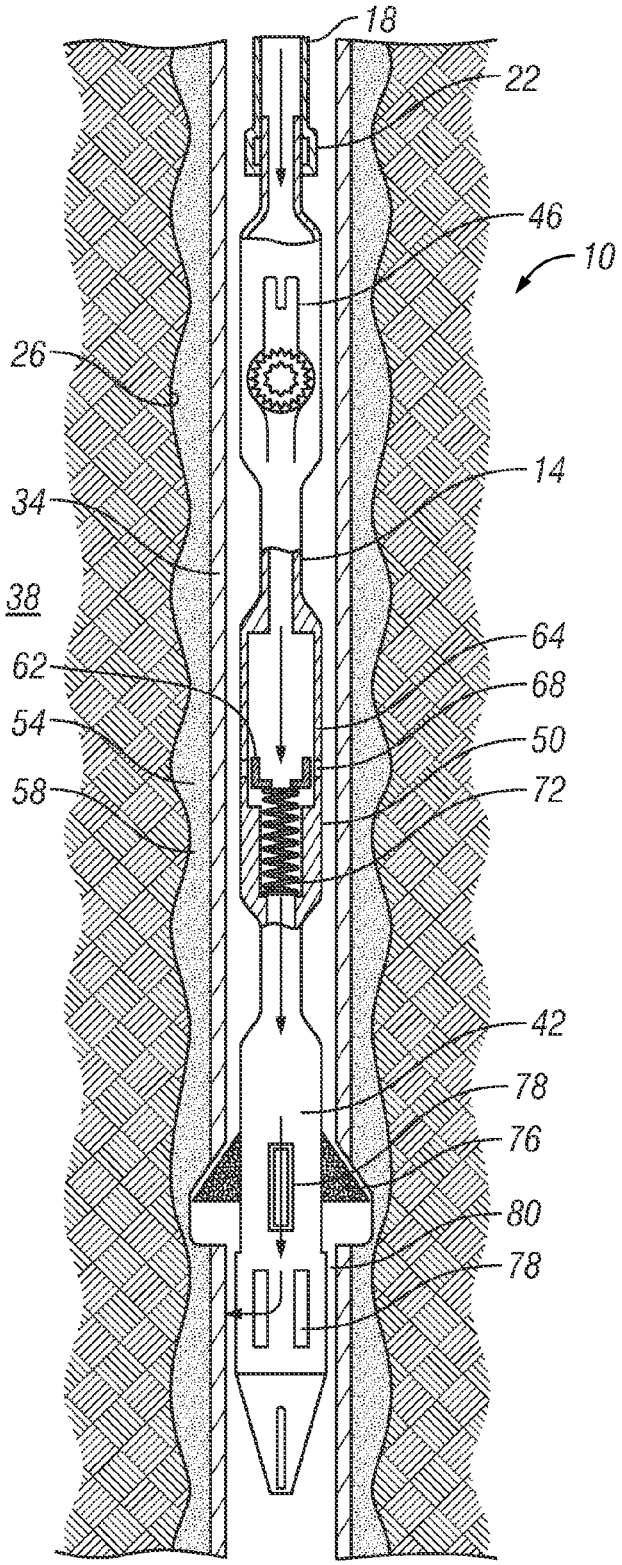
FIG. 1 depicts a cross sectional view of a borehole abandoning system disclosed herein with cutters deployed.
Figure 2:
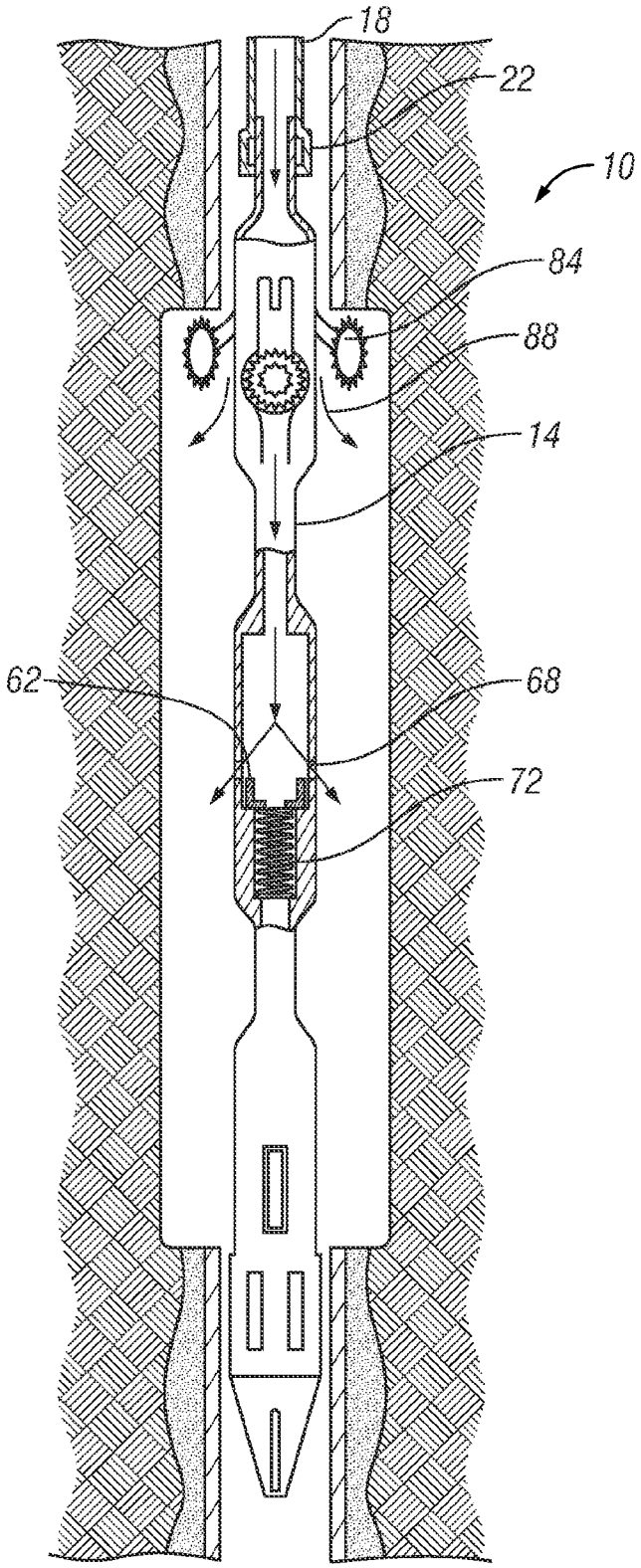
FIG. 2 depicts a cross sectional view of the borehole abandoning system of FIG. 1 with the cutters retracted and reamers deployed.

Referring to FIGS. 1 and 2, a borehole abandoning system is illustrated at 10. The borehole abandoning system 10 includes, a tool 14, disconnectably attached to a tubular 18 via a connector 22. The tool 14, tubular 18 and connector 22 are runnable within a borehole 26, shown in this embodiment as a well with a wellbore that is lined by a liner or casing 34 in an earth formation 38. The tool 14 includes a first portion 42, a second portion 46 and a valve 50 that is in operable communication with the first portion 42 and the second portion 46. In this embodiment the valve 50 is configured to control actuation of the first portion 42 and the second portion 46 by porting pressurized fluid to one of the first portion 42 or the second portion 46. The valve 50 can also control direction of circulation of fluid, pumped from surface through the tubular 18, for example, to facilitate removal of cuttings during cutting or reaming. The tubular 18, after disconnecting from the tool 14 is receptive to cement being pumped therethrough.

The foregoing borehole abandoning system 10 is able to plug and abandon the borehole 26 in a single run as follows. After being run into the borehole 26 to the desired position the borehole abandoning system 10 is able to cut the liner or casing 34 with the first portion 42 over a desired length of the lining or casing 34. The length of liner 34 that is cut can be adjusted by, for example, moving the tubular 18 and thus the system 10 during the cutting process. The first portion 42 can then be de-actuated and the second portion 46 actuated to ream, or open, the open borehole 26 or cement 54 and the open borehole 26 in cases wherein the annular space 58 between the casing 34 and the borehole 26 has been cemented. The system 10 and the tubular 18 can again be moved during the reaming process to ream the borehole 26 over part or all of the length that has had the casing 34 removed by the first portion 42. Subsequent disconnection of the tubular 18 from the tool 14 allows the tool 14 to remain in the borehole while cement is pumped through the tubular 18 to plug the borehole 26. Depending upon specific characteristics of the well the cost of performing multiple runs into and out of the borehole 26 to first cut the liner 34, then ream the formation 38 and then cement the borehole 26 and reamed formation 38, may be more than the cost of the tool 14 left downhole, thereby providing financial justification for leaving the tool 14 in the borehole 26 upon abandonment of the borehole 26.

It should be noted that although only two portions 42, 46 of the tool 14 are described in the foregoing embodiment, alternate embodiments are contemplated that can employ any number of additional portions of the tool 14 for performing additional operations, such as, cutting and/or reaming additional tubulars lining the borehole 26, for example.

Although different mechanisms can be employed to actuate the first portion 42 and the second portion 46, the embodiment disclosed herein employs hydraulic pressure supplied from surface, for example, to cause actuation thereof. The valve 50 is configured to direct pressurized fluid to one of the first portion 42 and the second portion 46. The valve 50 includes a piston 62 movable within a housing 64 having at least one port 68 (with two ports 68 being illustrated) that provides fluidic communication between an inside of the housing 64 to an outside. A biasing member 72, shown as a compression spring, urges the piston 62 to a position wherein it blocks the ports 68. Fluid provided at a selected pressure against the piston 62 insufficient to overcome the urging force of the biasing member 72 can flow past the valve 50, to the first portion 42 causing actuation thereof to extend cutting blades 76 of the first portion 42, as illustrated in FIG. 1. (It should be noted that fluid reaching the valve 50 and the first portion 42 has passed the second portion 46 without causing actuation thereof.) This pressure can also open flow passageways 78 at the cutting blades 76 or downstream of the cutting blades 76 as is illustrated in this embodiment to port fluid to the annular space 80, defined between the tool 14 and the casing 34, where it can be used to flush away cuttings generated during the cutting process. A plug, not shown, blocking fluidic flow downward beyond the tool 14 within the casing 34 can assure fluid flows upward within the annular space 80.

At pressures above a selected threshold the fluidic forces on the piston 62 are sufficient to compress the biasing member 72 allowing the piston 62 to move thereby uncovering the ports 68 and blocking flow of fluid to the first portion 42, as illustrated in FIG. 2. At this pressure, or at a greater selected pressure, the second portion 46 is actuated. This actuation includes extension of reaming blades 84 and opening of fluid passageways 88, around or near the blades 84. Although in this embodiment fluid is able to flow out through both the flow passageways 88 and the ports 68 when the second portion 46 is actuated, alternate embodiments could permit fluid flow through only one or the other and not both, for example.

Additionally, in alternate embodiments the relative locations of the first portion 42 and the second portion 46 could be reversed. That is, the cutting first portion 42 could be located uphole of the valve 50 and the reamer second portion 46. Doing so would require changes to the valve 50, for example, such that fluid is initially blocked from reaching the second portion 46 until after the first portion 42 has been actuated and has cut the desired length of the casing 34.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A method of abandoning a borehole, comprising:
running a tool into the borehole;
cutting a casing with a first portion of the tool;
reaming the borehole in an area where the casing has been cut with a second portion of the tool;
disconnecting a drillstring from the tool; and
cementing the borehole through the drillstring all during a single trip within the borehole.

2. The method of abandoning a borehole of claim 1, further comprising circulating fluid over the first portion during the cutting.

3. The method of abandoning a borehole of claim 1, further comprising circulating fluid over the second portion during the reaming.

4. The method of abandoning a borehole of claim 1, further comprising porting circulating fluid through a valve positioned between the first portion and the second portion.

5. The method of abandoning a borehole of claim 1, further comprising actuating the first portion of the tool hydraulically through a valve.

6. The method of abandoning a borehole of claim 1, further comprising actuating the second portion of the tool hydraulically through a valve.

7. The method of abandoning a borehole of claim 1, further comprising directing fluid pressure to one of the first portion and the second portion through a valve based on selected pressures.

8. The method of abandoning a borehole of claim 1, further comprising cutting or reaming an additional tubular lining the borehole with at least a third portion of the tool.

* * * * *